US012577698B2

(12) United States Patent
Tomita et al.

(10) Patent No.: US 12,577,698 B2
(45) Date of Patent: Mar. 17, 2026

(54) PLATING APPARATUS

(71) Applicant: EBARA CORPORATION, Tokyo (JP)

(72) Inventors: Masaki Tomita, Tokyo (JP); Ryosuke Hiwatashi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 726 days.

(21) Appl. No.: 17/911,044

(22) PCT Filed: Oct. 28, 2021

(86) PCT No.: PCT/JP2021/039795
§ 371 (c)(1),
(2) Date: Sep. 12, 2022

(87) PCT Pub. No.: WO2023/073862
PCT Pub. Date: May 4, 2023

(65) Prior Publication Data

US 2024/0209539 A1 Jun. 27, 2024

(51) Int. Cl.
*C25D 17/06* (2006.01)
*C25D 17/00* (2006.01)
(Continued)

(52) U.S. Cl.
CPC ..... *C25D 17/06* (2013.01); *C25D 17/00* (2013.01); *C25D 17/001* (2013.01); *C25D 17/08* (2013.01); *C25D 21/12* (2013.01)

(58) Field of Classification Search
CPC ..... C25D 17/06; C25D 17/00; C25D 17/001; C25D 17/08; C25D 17/005; C25D 17/007; C25D 21/12
See application file for complete search history.

(56) References Cited

U.S. PATENT DOCUMENTS 6,558,518 B1 * 5/2003 Sendai ..... C25D 7/123 204/224 R
7,935,231 B2 5/2011 Ghongadi et al.
(Continued)

FOREIGN PATENT DOCUMENTS

JP 2005-264245 A 9/2005
JP 2019104973 A * 6/2019
(Continued)

*Primary Examiner* — James Lin
*Assistant Examiner* — Kevin Sylvester
(74) *Attorney, Agent, or Firm* — BakerHostetler

(57) ABSTRACT

An occurrence of a varied power feeding to a contact member is suppressed.
A substrate holder includes: a frame-shaped supporting mechanism configured to be suspended and held by a plurality of support pillars and to support an outer peripheral portion of a surface to be plated of a substrate; a back plate assembly configured to be arranged on a back surface side of the surface to be plated of the substrate and to sandwich the substrate with the supporting mechanism; a contact member 468 arranged on the supporting mechanism; and a plurality of power source line members 461. The contact member 468 has a power feeding contact point in contact with the outer peripheral portion of the surface to be plated of the substrate and a plurality of power source connecting portions 469*b* connected to a power source. The plurality of power source line members 461 are connected from the power source to the plurality of power source connecting portions 469*b* through the plurality of support pillars, and are routed such that distances from the power source to the plurality of power source connecting portions 469*b* become equal.

3 Claims, 14 Drawing Sheets

(51) Int. Cl.
*C25D 17/08* (2006.01)
*C25D 21/12* (2006.01)

(56) References Cited

U.S. PATENT DOCUMENTS

| | | | | |
|---|---|---|---|---|
| 2009/0107835 | A1* | 4/2009 | Ghongadi | C25D 21/08 204/279 |
| 2016/0348264 | A1* | 12/2016 | Fujikata | C25D 17/02 |
| 2019/0249326 | A1* | 8/2019 | Mine | H01L 21/68785 |
| 2019/0390360 | A1* | 12/2019 | Shimomura | C25D 5/08 |
| 2022/0098750 | A1* | 3/2022 | Murakoshi | C25D 17/06 |
| 2022/0364255 | A1* | 11/2022 | Tomita | C25D 17/06 |

FOREIGN PATENT DOCUMENTS

| | | | |
|---|---|---|---|
| JP | 6899040 | B1 | 7/2021 |
| KR | 2020-0021919 | A | 3/2020 |
| WO | WO 2020/152920 | A1 | 7/2020 |

* cited by examiner

1000

PLATING APPARATUS

TECHNICAL FIELD

This application relates to a plating apparatus.

BACKGROUND ART

There has been known a cup type electroplating apparatus as one example of a plating apparatus. The cup type electroplating apparatus immerses a substrate (for example, a semiconductor wafer) held by a substrate holder with a surface to be plated facing downward in a plating solution, and applies a voltage between the substrate and an anode to deposit a conductive film on the surface of the substrate.

For example, PTL 1 discloses a substrate holder of an electroplating apparatus that includes a ring-shaped supporting member that supports an outer peripheral portion of a surface to be plated of a substrate and a ring-shaped contact member arranged on the supporting member, and is configured to apply a voltage to a substrate via the contact member. This substrate holder is configured to apply a voltage from a power source to the contact member via a plurality of support pillars for suspending and holding the supporting member.

CITATION LIST

Patent Literature

PTL 1: U.S. Pat. No. 7,935,231

SUMMARY OF INVENTION

Technical Problem

The substrate holder of the prior art has a room for improvement in the point of suppressing an occurrence of varied power feeding to the contact member.

That is, the substrate holder of the prior art includes a ring-shaped conductive busbar to which lower end portions of a plurality of support pillars are connected, and is configured to feed power to a contact member by bringing the busbar into contact with the contact member. In this case, since distances from the plurality of support pillars with respect to a circumferential direction of an outer peripheral portion of a surface to be plated of a substrate become unequal, an electric potential distribution of the outer peripheral portion of the surface to be plated of the substrate becomes unequal, and as a result, unevenness in a plating film-thickness may possibly occur.

Therefore, an object of the present disclosure is to suppress an occurrence of varied power feeding to a contact member.

Solution to Problem

One embodiment discloses a plating apparatus including: a plating tank configured to house a plating solution; a substrate holder configured to hold a substrate with a surface to be plated facing downward; and an elevating mechanism configured to elevate the substrate holder. The substrate holder includes: a frame-shaped supporting mechanism configured to be suspended and held by a plurality of support pillars and to support an outer peripheral portion of the surface to be plated of the substrate; a back plate assembly configured to be arranged on a back surface side of the surface to be plated of the substrate and to sandwich the substrate with the supporting mechanism; a contact member arranged on the supporting mechanism, the contact member having a power feeding contact point in contact with the outer peripheral portion of the surface to be plated of the substrate and a plurality of power source connecting portions connected to a power source; and a plurality of power source line members connected from the power source to the plurality of power source connecting portions through the plurality of support pillars, the plurality of power source line members being routed such that distances from the power source to the plurality of power source connecting portions become equal.

DESCRIPTION OF EMBODIMENTS

Figure 1:
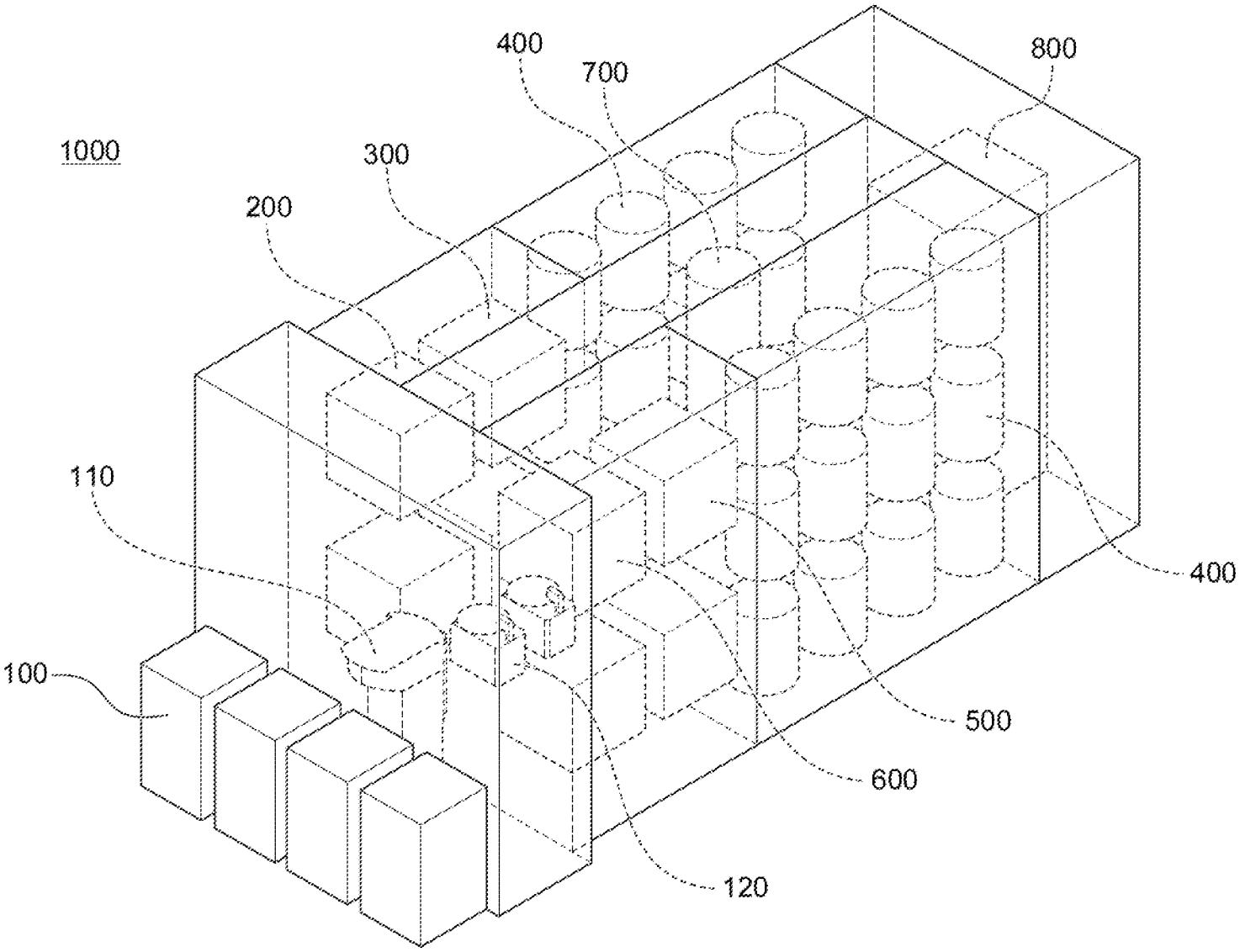
FIG. 1 is a perspective view illustrating an overall configuration of a plating apparatus of this embodiment.

The following describes embodiments of the present invention with reference to the drawings. In the drawings described below, identical reference numerals are attached to identical or equivalent components, and overlapping descriptions will be omitted.

<Overall Configuration of Plating Apparatus>

Figure 2:
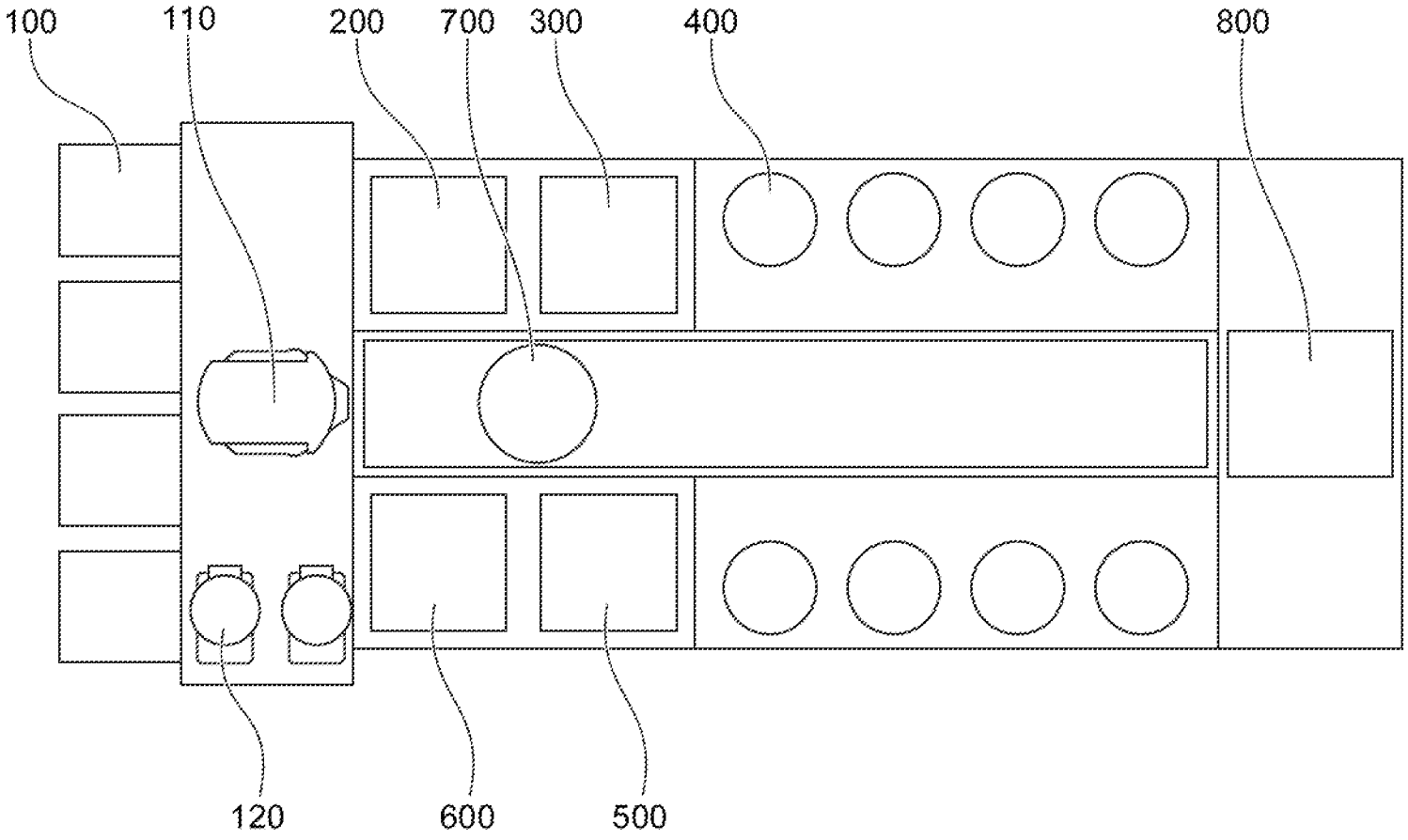
FIG. 2 is a plan view illustrating the overall configuration of the plating apparatus of this embodiment.

FIG. 1 is a perspective view illustrating an overall configuration of a plating apparatus of this embodiment. FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP (not illustrated), to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, the pre-wet module 200, and the spin rinse dryer 600. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the pre-wet module 200.

The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer robot 110 receives the substrate from the spin rinse dryer 600 and transfers the substrate on which the drying process is performed to the cassette at the load port 100. Finally, the cassette housing the substrate is unloaded from the load port 100.

<Configuration of Plating Module>

Figure 3:
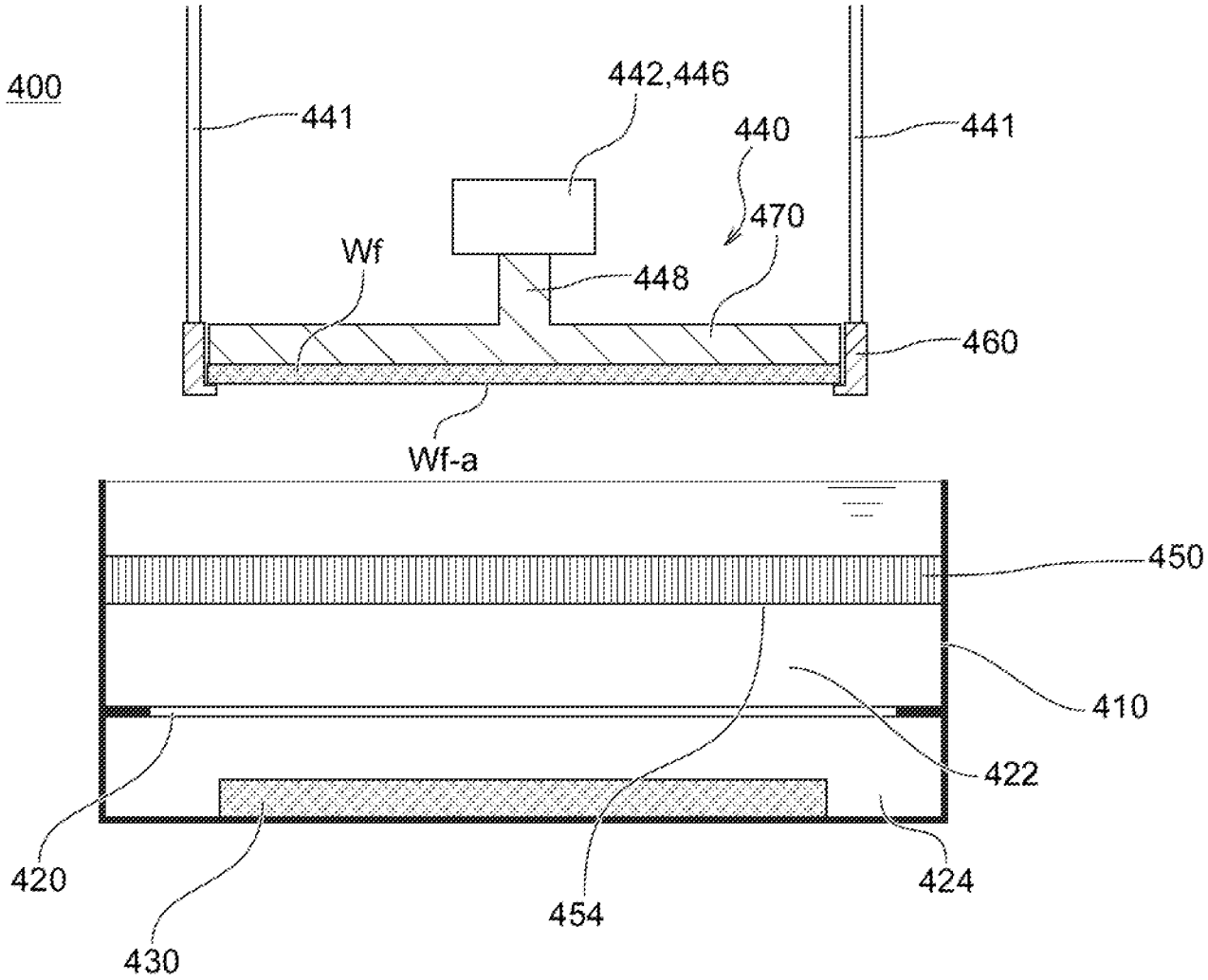
FIG. 3 is a vertical cross-sectional view schematically illustrating a configuration of a plating module of this embodiment.

Next, a configuration of the plating modules 400 will be described. Since the 24 plating modules 400 in this embodiment have the identical configuration, only one plating module 400 will be described. FIG. 3 is a vertical cross-sectional view schematically illustrating the configuration of the plating module of this embodiment. As illustrated in FIG. 3, the plating module 400 includes a plating tank 410 for housing a plating solution. The plating module 400 includes a membrane 420 that separates an inside of the plating tank 410 in the vertical direction. The inside of the plating tank 410 is divided into a cathode region 422 and an anode region 424 by the membrane 420. The cathode region 422 and the anode region 424 are each filled with the plating solution. An anode 430 is disposed on a bottom surface of the plating tank 410 in the anode region 424. An ionically resistive element 450 opposed to the membrane 420 is arranged in the cathode region 422. The ionically resistive element 450 is a member for uniformizing the plating process on a surface to be plated Wf-a of a substrate Wf and is configured of a plate-shaped member in which many holes are formed.

Further, the plating module 400 includes a substrate holder 440 for holding the substrate Wf with the surface to be plated Wf-a facing downward. The substrate holder 440 includes a ring-shaped supporting mechanism 460 for supporting an outer peripheral portion of the surface to be plated Wf-a of the substrate Wf, a back plate assembly 470 for sandwiching the substrate Wf with the supporting mechanism 460, and a rotation shaft 448 extending vertically upward from the back plate assembly 470. The supporting mechanism 460 is suspended and held by a plurality of support pillars 441 (two of which are illustrated in FIG. 3 but there are actually four).

The plating module 400 includes an elevating mechanism 442 for elevating the substrate holder 440. The elevating mechanism 442 can be achieved by the known mechanism, such as a motor. The plating module 400 is configured to perform a plating process on the surface to be plated Wf-a of the substrate Wf by immersing the substrate Wf in the plating solution of the cathode region 422 using the elevating mechanism 442 and applying a voltage between the anode 430 and the substrate Wf.

Further, the plating module 400 includes a rotation mechanism 446 for rotating the substrate holder 440 about the rotation shaft 448 such that the substrate Wf rotates about a virtual rotation axis extending perpendicularly in the center of the surface to be plated Wf-a. The rotation mechanism 446 can be achieved by the known mechanism, such as a motor.

<Configuration of Substrate Holder>

Figure 4:
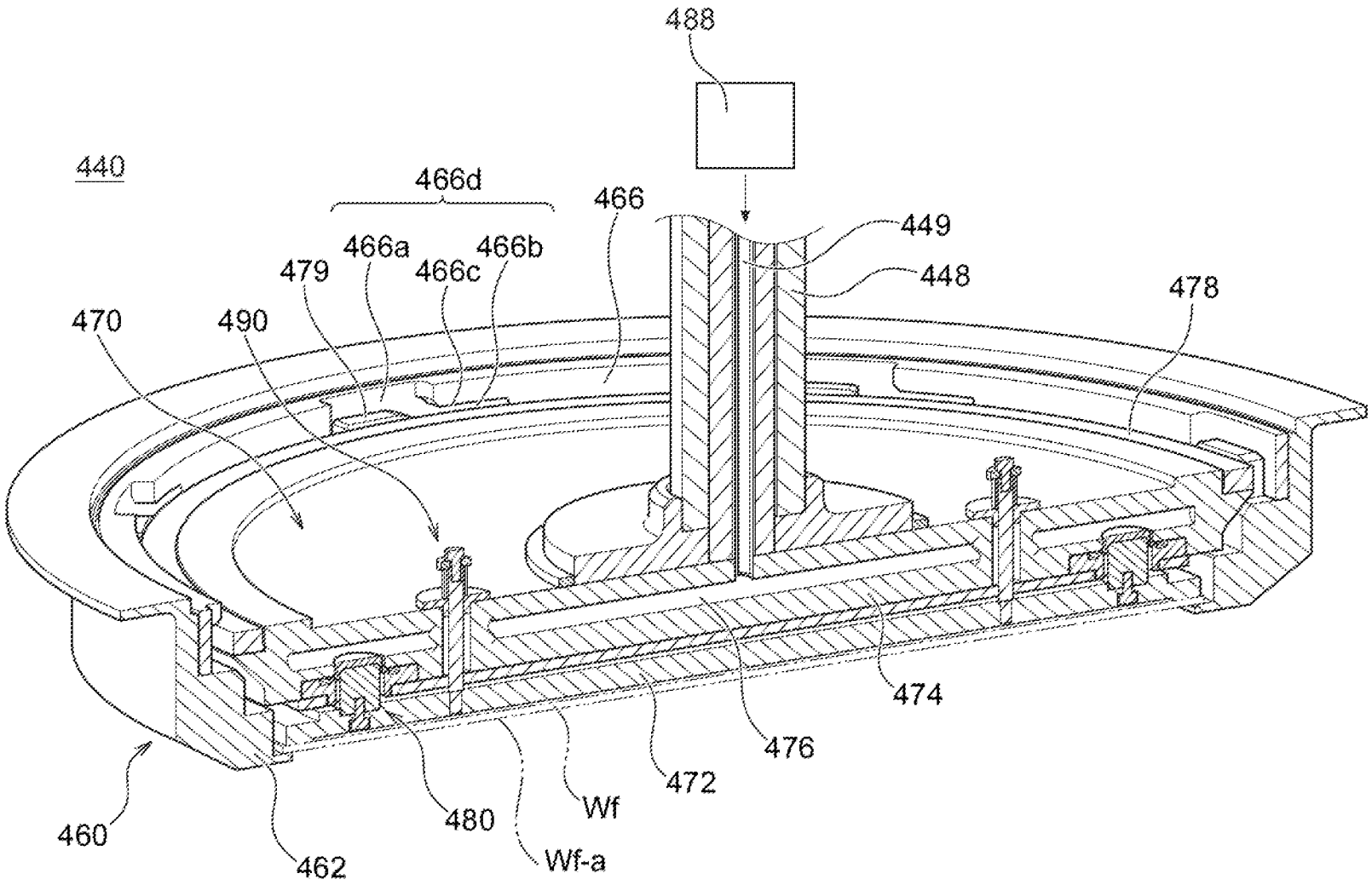
FIG. 4 is a perspective view schematically illustrating a configuration of a substrate holder of this embodiment.
Figure 5:
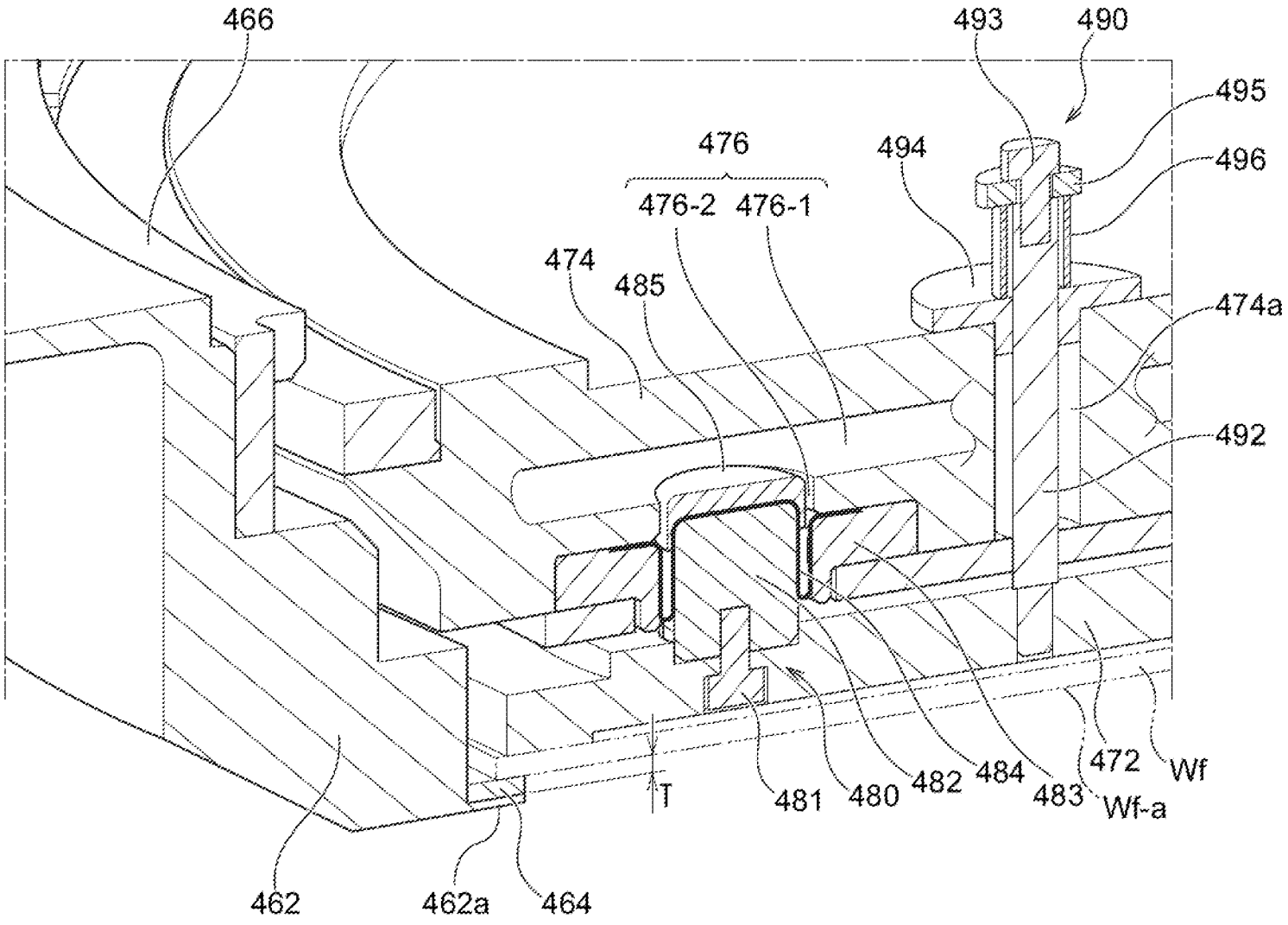
FIG. 5 is an enlarged perspective view schematically illustrating a part of the substrate holder of this embodiment.

Next, details of the substrate holder 440 of this embodiment will be described. FIG. 4 is a perspective view schematically illustrating a configuration of the substrate holder of this embodiment. FIG. 5 is an enlarged perspective view schematically illustrating a part of the substrate holder of this embodiment.

As illustrated in FIG. 4 and FIG. 5, the back plate assembly 470 includes a circular plate-shaped floating plate 472 for sandwiching the substrate Wf with the supporting mechanism 460. The floating plate 472 is arranged on a back surface side of the surface to be plated Wf-a of the substrate Wf. Further, the back plate assembly 470 includes floating mechanisms 490 for biasing the floating plate 472 to a direction away from the back surface of the substrate Wf. Further, the back plate assembly 470 includes pressing mechanisms 480 for pressing the floating plate 472 to the back surface of the substrate Wf against a biasing force to the floating plate 472 by the floating mechanisms 490.

The pressing mechanism 480 includes a circular plate-shaped back plate 474 arranged on an upper side of the floating plate 472 and a flow passage 476 formed inside the back plate 474. The flow passage 476 includes a first flow passage 476-1 and second flow passages 476-2. The first flow passage 476-1 extends radially from a center portion of the back plate 474 toward an outer peripheral portion. The second flow passages 476-2 extend in the vertical direction so as to open from the first flow passage 476-1 to a lower surface of the back plate 474. The pressing mechanism 480 includes diaphragms 484 arranged in the second flow passages 476-2. The diaphragm 484 is a thin film-shaped member. The diaphragm 484 has an outer peripheral portion secured to the lower surface of the back plate 474 by a securing member 483. The pressing mechanism 480 includes a rod 482 as an aspect of pressing members arranged between the diaphragm 484 and the floating plate 472. The rod 482 has a lower surface secured to the floating plate 472 by a bolt 481, and the rod 482 has an upper surface in contact with a lower surface of the diaphragm 484. The rod 482 has an upper portion covered with a cap 485 sandwiching the diaphragm 484. The diaphragm 484 has a center portion sandwiched by the cap 485 and the rod 482. A plurality of the diaphragms 484, the rods 482, and the caps 485 are disposed along the circumferential direction of the back plate assembly 470. Note that, while this embodiment has shown the example in which the rods 482 as different members from the floating plate 472 are secured to the upper surface of the floating plate 472, it is not limited thereto. For example, projections may be formed on the upper surface of the floating plate 472 along the circumferential direction. In this case, the projections have a function as the pressing members similar to the rods 482.

The pressing mechanism 480 includes a fluid source 488 for supplying a fluid to the diaphragms 484. The fluid may be a gas, such as air, or may be a liquid, such as water. In the rotation shaft 448, a flow passage 449 extending along the gravity direction is formed, and the fluid source 488 is connected to an upper end of the flow passage 449. The flow passage 449 has a lower end connected to the first flow passage 476-1 formed in the back plate 474. The first flow passage 476-1 extends radially from the center of the back plate 474 and communicates with upper surfaces of the caps 485 via the second flow passages 476-2. The fluid source 488 supplies the fluid to the diaphragms 484 via the flow passage 449 and the flow passage 476. Then, the caps 485 and the rods 482 are pressed downward, whereby the floating plate 472 is pressed downward.

The supporting mechanism 460 includes a circular supporting member 462 for supporting the outer peripheral portion of the surface to be plated Wf-a of the substrate Wf. The supporting member 462 has a flange **462*a* protruding to an outer peripheral portion of a lower surface of the back plate assembly 470. A circular sealing member 464 is arranged on the flange 462*a*. The sealing member 464 is a member having elasticity. The supporting member 462 supports the outer peripheral portion of the surface to be plated Wf-a of the substrate Wf via the sealing member 464. Sandwiching the substrate Wf between the sealing member 464 and the floating plate 472 seals between the supporting member 462 and the substrate Wf. Since the sealing member 464 has elasticity, the sealing member 464 is crushed in accordance with the pressing force of the substrate Wf by the pressing mechanism 480**, thus causing a thickness T to vary.

The supporting mechanism 460 includes a circular clamper 466 held by the supporting member 462. The clamper 466 can elevate the back plate assembly 470 with respect to the supporting mechanism 460 when the substrate Wf is installed to/extracted from the substrate holder 440. Further, the clamper 466 can restrict the back plate 474 from moving to an upward direction (direction away from the back surface of the substrate Wf) when the fluid is supplied from the fluid source 488 to the diaphragm 484. This point will be described below.

The back plate assembly 470 includes a slide ring 478 circularly disposed on the outer peripheral portion of an upper surface of the back plate 474. The slide ring 478 is movable in the circumferential direction independently of the back plate 474. The back plate assembly 470 includes slide plates 479 projecting from the slide ring 478 toward the clamper 466.

On the other hand, hook-like cutouts **466*d* are formed on a surface opposed to the slide ring 478 in the clamper 466. The hook-like cutout 466*d* has a first groove 466*a* and a second groove 466*b*. The first groove 466*a* extends in the vertical direction such that the slide plate 479 can be elevated. The second groove 466*b* communicates with the first groove 466*a* and extends along the circumferential direction of the clamper 466. The second groove 466*b* has an upper surface on which an abutting surface 466*c* is formed. The abutting surface 466*c* abuts on an upper surface of the slide plate 479 that moves in accordance with a movement in the upward direction of the back plate 474 when the fluid is supplied from the fluid source 488 to the diaphragms 484. A plurality of the slide plates 479 and the cutouts 466***d* are disposed along the circumferential direction of the substrate holder 440.

When the substrate Wf is installed with respect to the substrate holder 440, the back plate assembly 470 is positioned on an upper side with respect to the supporting mechanism 460. When the substrate Wf is placed with respect to the supporting mechanism 460 in this state, the back plate assembly 470 can be moved down with respect to the supporting mechanism 460 by adjusting a position in the circumferential direction of the slide plates 479 to the first grooves 466*a*. After the back plate assembly 470 is moved down, the slide plates 479 are fit in the second grooves 466*b* by rotating the slide ring 478 in the circumferential direction. Since this causes the slide plates 479 and the abutting surfaces 466*c* to be opposed, a movement in the upward direction of the back plate assembly 470 is restricted.

The floating mechanism 490 includes a shaft 492 extending from the floating plate 472 to the upper side via a through-hole 474*a* of the back plate 474. The shaft 492 has a lower end secured to the floating plate 472. The floating mechanism 490 includes a flange 495 mounted on a portion of the shaft 492 above the back plate 474. The flange 495 is mounted on an upper end of the shaft 492 by a bolt 493. The floating mechanism 490 includes a guide 494 disposed in the through-hole 474*a*. The guide 494 has a hole slightly larger than an outer diameter of the shaft 492 and is mounted on an upper end of the through-hole 474*a*. The guide 494 is configured to guide a movement in an elevating direction of the shaft 492. By providing the guide 494, an occurrence of misalignment in a radial direction of the floating plate 472 and the back plate 474 can be suppressed.

The floating mechanism 490 includes a compression spring 496 mounted on an upper surface of the guide 494 and a lower surface of the flange 495. The compression spring 496 may be disposed between the upper surface of the back plate 474 and the lower surface of the flange 495. Since the compression spring 496 has a biasing force that lifts the flange 495 upward, the floating plate 472 is biased to the direction away from the back surface of the substrate Wf via the shaft 492.

When the fluid is supplied from the fluid source 488, the pressing mechanisms 480 presses the substrate Wf to the sealing member 464 with a force stronger than the biasing force to the substrate Wf by the floating mechanisms 490. The pressing mechanism 480 can vary a holding position of the substrate Wf depending on a pressure of the fluid supplied from the fluid source 488.

As the pressure of the fluid supplied from the fluid source 488 increases, a crushing amount of the sealing member 464 increases. Therefore, the thickness of the sealing member 464 becomes thin in proportion to the increase in the pressure of the fluid supplied from the fluid source 488. The thickness of the sealing member 464 becoming thin means that the holding position of the substrate Wf moves downward, which means that a distance between the anode 430 and the substrate Wf becomes short. That is, by adjusting a flow rate of the fluid supplied from the fluid source 488, the distance between the anode 430 and the substrate Wf can be adjusted. Accordingly, with this embodiment, by adjusting the distance between the anode 430 and the substrate Wf depending on a type of the substrate Wf, uniformity of a plating film-thickness on the surface to be plated Wf-a can be improved. Note that, in FIG. 4 and FIG. 5, the support pillars 441 are not illustrated.

<Configurations of Power Source Line Member and Contact Member>

Figure 6:
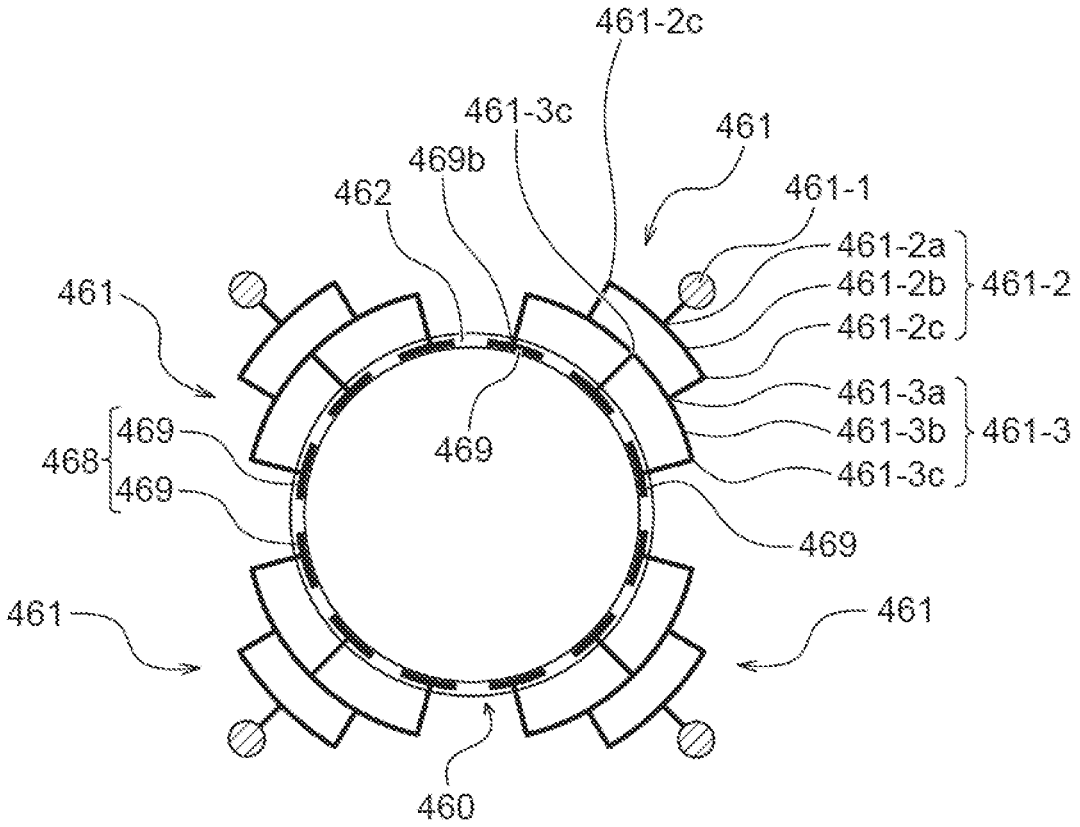
FIG. 6 is a drawing schematically illustrating a routing state of power source line members of this embodiment.
Figure 7:
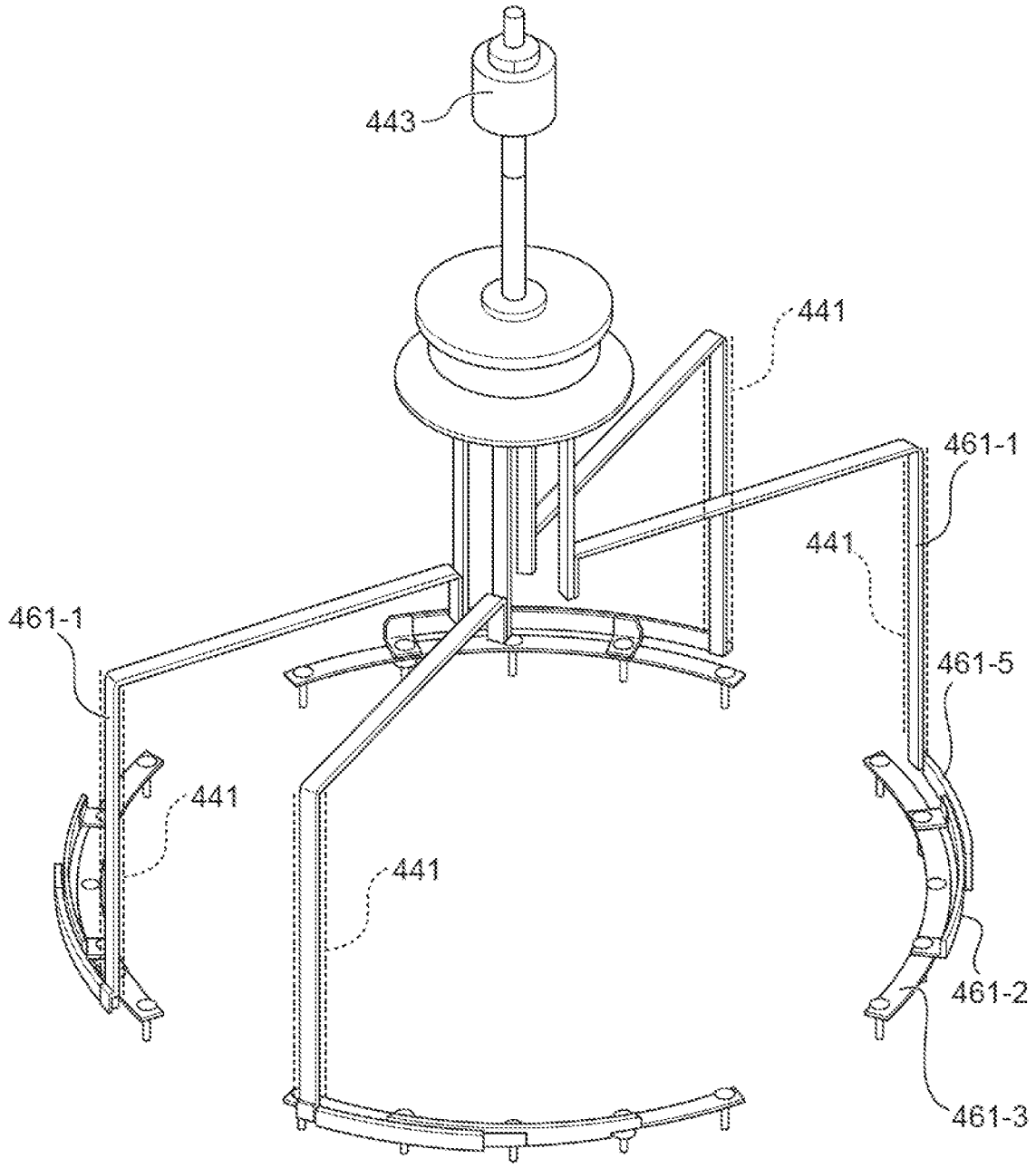
FIG. 7 is a perspective view schematically illustrating the power source line members of this embodiment.
Figure 8:
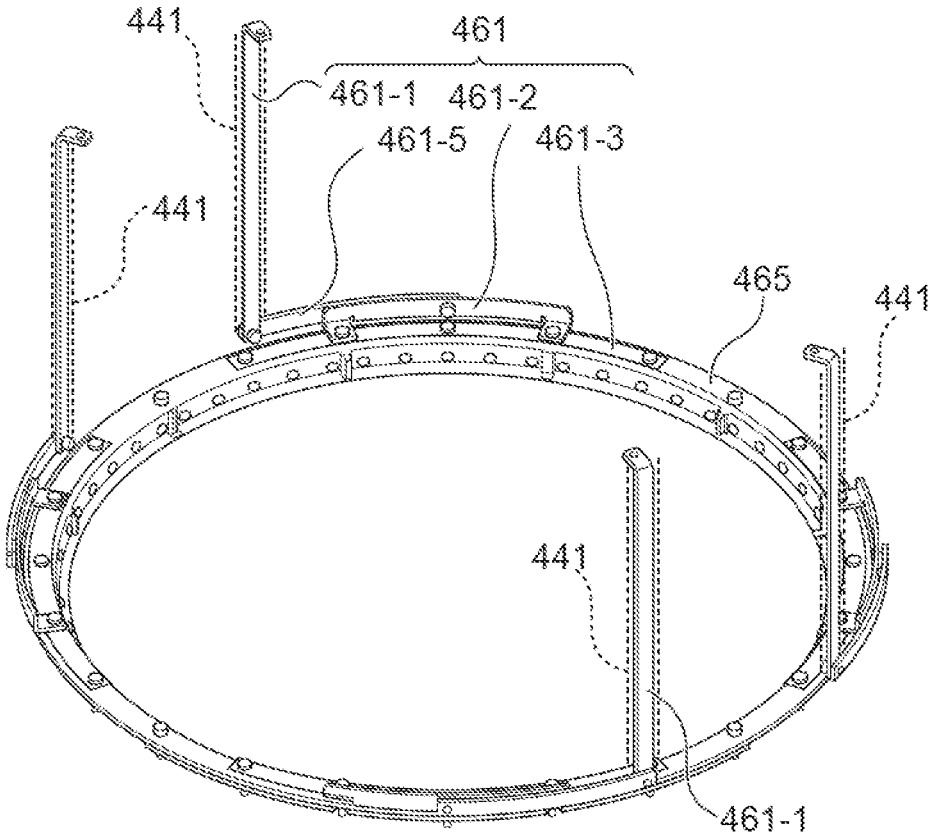
FIG. 8 is a perspective view schematically illustrating the power source line members of this embodiment.

Next, configurations of power source line members and a contact member will be described. FIG. 6 is a drawing schematically illustrating a routing state of the power source line members of this embodiment. FIG. 7 is a perspective view schematically illustrating the power source line members of this embodiment. FIG. 8 is a perspective view schematically illustrating the power source line members of this embodiment. Note that, in FIG. 7 and FIG. 8, for convenience of explanation, the support pillars 441 are indicated by dashed lines.

As illustrated in FIG. 6, the substrate holder 440 includes a contact member 468 arranged on the supporting mechanism 460 (supporting member 462). The contact member 468 is a member having a function of applying a voltage for plating process to the substrate Wf. Specifically, the contact member 468 includes a plurality (12 pieces in this embodiment) of contacts 469 arranged along a circumferential direction of the supporting mechanism 460. The plurality of contacts 469 are thin plate-shaped members having conductive property, such as gold or stainless steel. Each contact 469 has a power source connecting portion 469*b* connected to a power source. Accordingly, in this embodiment, the contact member 468 includes a plurality (12 pieces) of the power source connecting portions 469*b* arranged along the circumferential direction of the supporting mechanism 460.

As illustrated in FIG. 7 and FIG. 8, the substrate holder 440 includes a plurality (four systems corresponding to the number of support pillars 441 in this embodiment) of power source line members 461 routed from a power source 443 passing through the plurality of support pillars 441. The power source line member 461 is a member having conductive property, such as copper. As illustrated in FIG. 6, the power source line members 461 of four systems are each branched in a tournament shape and connected to a plurality of the power source connecting portions 469*b* such that distances from the power source 443 to the plurality of power source connecting portions 469*b* become equal. The following describes specific structures of the contact member 468 and the power source line members 461.

Figure 9:
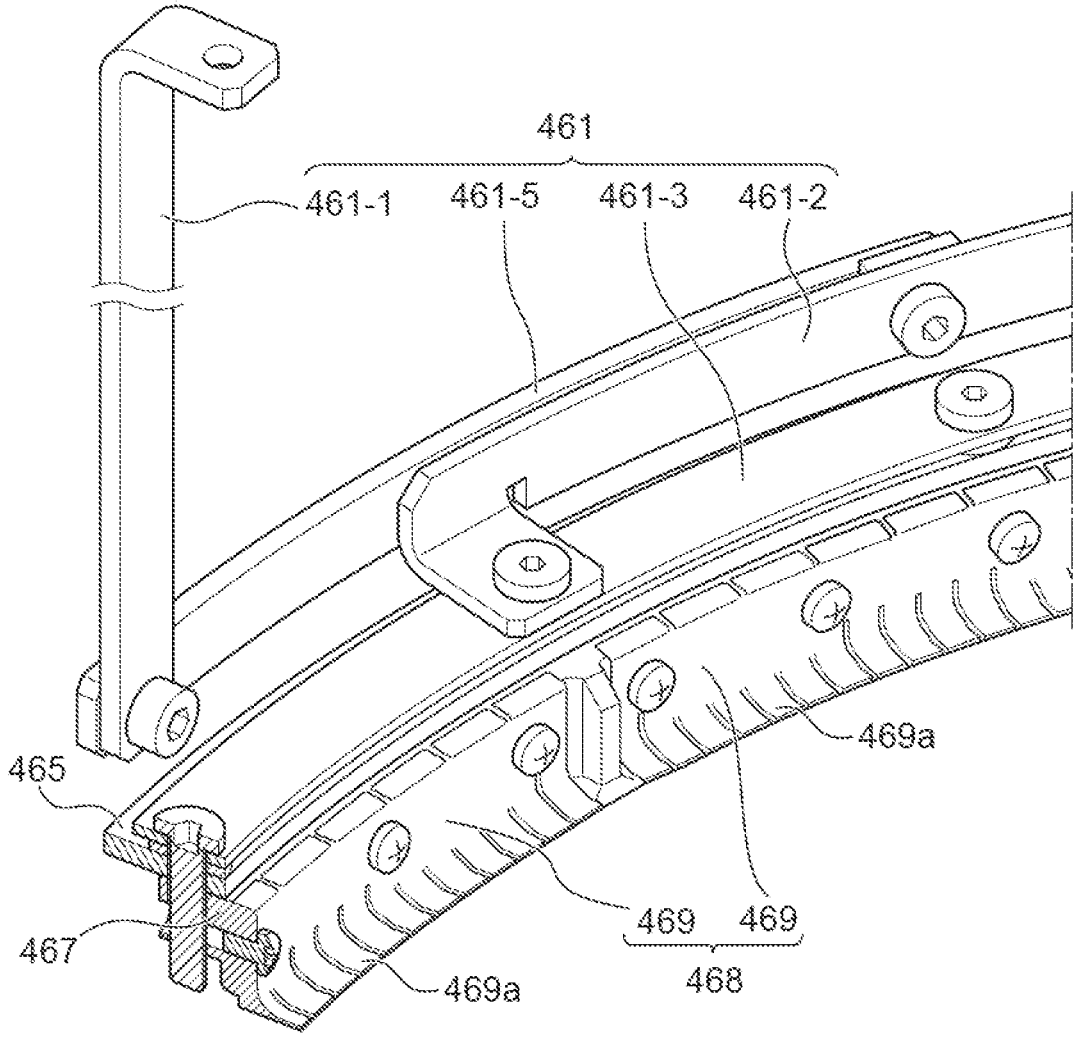
FIG. 9 is an enlarged perspective view schematically illustrating a part of the power source line member and a contact member of this embodiment.
Figure 10:
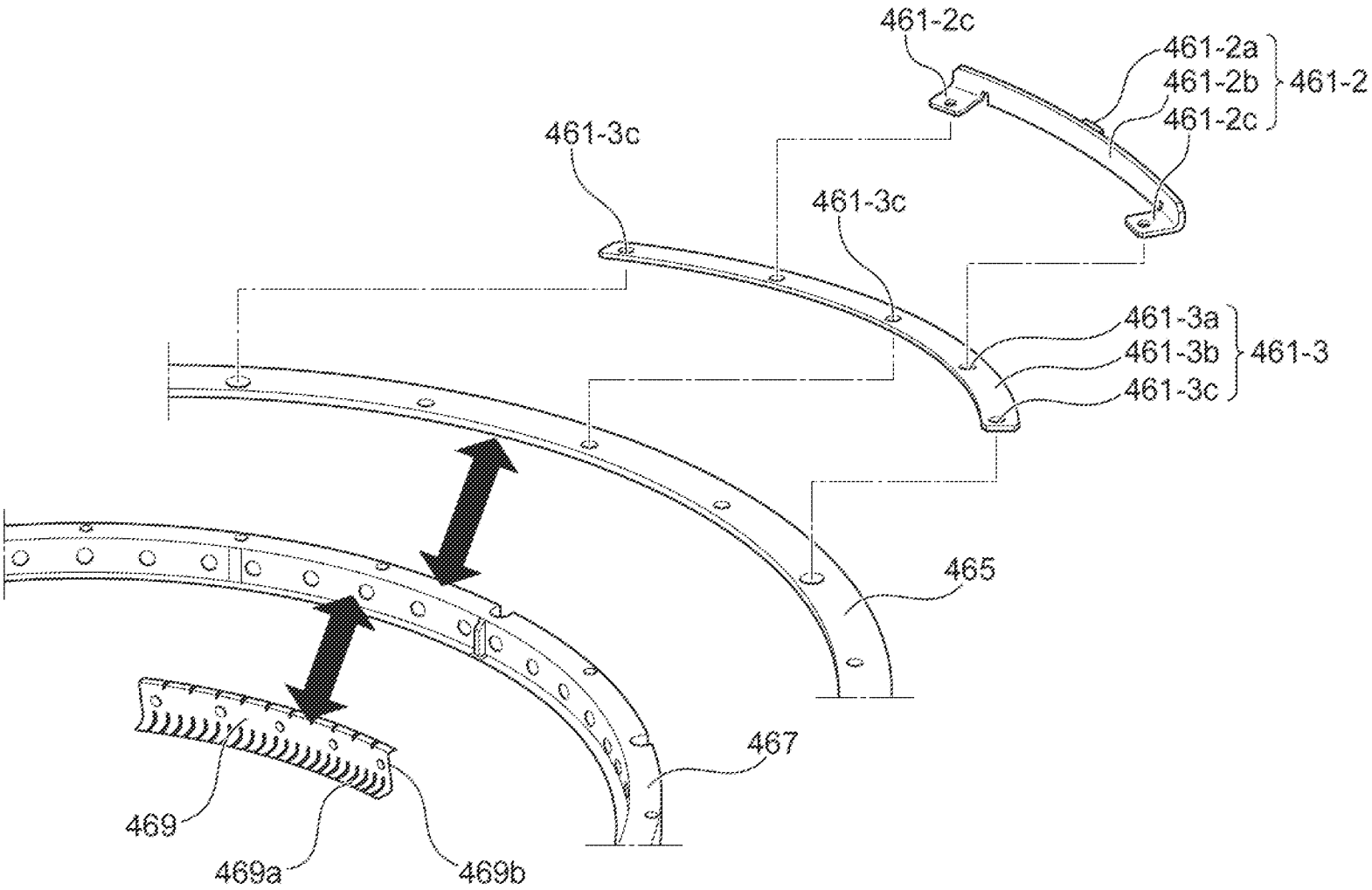
FIG. 10 is an exploded view schematically illustrating the power source line member and the contact member of this embodiment.
Figure 11:
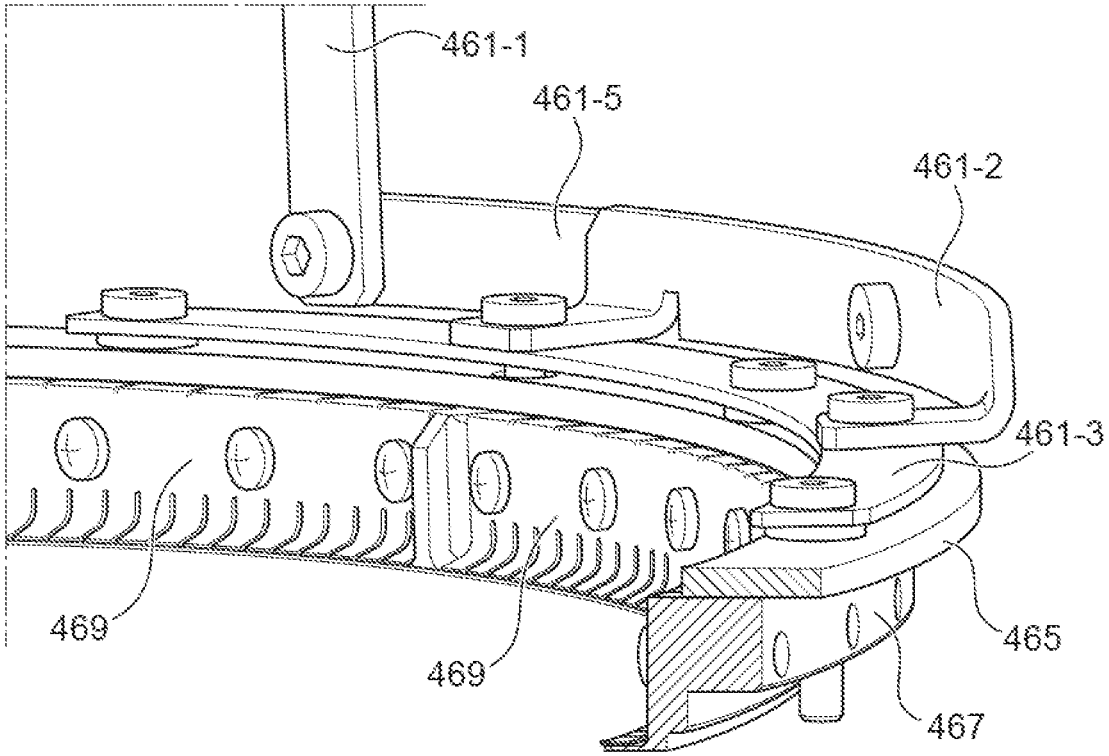
FIG. 11 is a perspective view schematically illustrating the power source line member and the contact member of this embodiment.

FIG. 9 is an enlarged perspective view schematically illustrating a part of the power source line member and the contact member of this embodiment. FIG. 10 is an exploded view schematically illustrating the power source line member and the contact member of this embodiment. FIG. 11 is a perspective view schematically illustrating the power source line member and the contact member of this embodiment.

illustrated in FIG. 9 to FIG. 11, each contact 469 is attached to an inner peripheral surface of a ring-shaped pedestal 467 by a screw or the like. The pedestal 467 is a member having conductive property, such as stainless steel. Each contact 469 is arranged on the supporting member 462 (not illustrated in FIG. 9 to FIG. 11) via the pedestal 467. Each contact 469 includes a plurality of power feeding contact points 469*a* in contact with the outer peripheral portion of the surface to be plated Wf-a of the substrate Wf. In this embodiment, a contact surface of the contact 469 in contact with the pedestal 467 corresponds to the power source connecting portion 469*b*.

As illustrated in FIG. 9 to FIG. 11, the plurality (four systems) of power source line members 461 each include a first power source line 461-1 extending from the power source passing through the support pillar 441, and a second power source line 461-2 connected to the first power source line 461-1 via a coupling line 461-5 described in the following. As illustrated in FIG. 6 and FIG. 10, the second power source line 461-2 has a first connecting portion 461-2*a* connected to the first power source line 461-1 via the coupling line 461-5. Further, the second power source line 461-2 has a first extending portion 461-2*b* extending from the first connecting portion 461-2*a* in both sides along the circumferential direction of the supporting mechanism 460, and a plurality (two pieces in this embodiment) of second connecting portions 461-2*c* disposed at positions equidistant from the first connecting portion 461-2*a* of the first extending portion 461-2*b*. As described in the following, the second power source line 461-2 is connected to a plurality of the power source connecting portions 469*b* via the plurality of second connecting portions 461-2*c*.

As illustrated in FIG. 9 and FIG. 11, the plurality of power source line members 461 each include the coupling line 461-5 connecting the first power source line 461-1 and the second power source line 461-2. The coupling lines 461-5 each extend from the first power source line 461-1 along the circumferential direction of the supporting mechanism 460 such that the first connecting portions 461-2*a* of the second power source lines 461-2 are arranged at equal intervals (90° intervals in this embodiment as illustrated in FIG. 6) along the circumferential direction of the supporting mechanism 460. By disposing the coupling lines 461-5, even in a case where the support pillars 441 are not arranged at equal intervals along the circumferential direction of the supporting mechanism 460, the first connecting portions 461-2*a* can be arranged at equal intervals along the circumferential direction of the supporting mechanism 460.

Further, the plurality of power source line members 461 each include a third power source line 461-3 connected to the second power source line 461-2. As illustrated in FIG. 6 and FIG. 10, the third power source line 461-3 has a plurality of third connecting portions 461-3*a* connected to the plurality of second connecting portions 461-2*c* of the second power source line 461-2. Further, the third power source line 461-3 has a second extending portion 461-3*b* extending from the third connecting portions 461-3*a* along the circumferential direction of the supporting mechanism 460 and a plurality (three pieces in this embodiment) of fourth connecting portions 461-3*c* disposed at positions equidistant from the third connecting portions 461-3*a* of the second extending portion 461-3*b*. As described in the following, the third power source line 461-3 is connected to a plurality of the power source connecting portions 469*b* via the plurality of fourth connecting portions 461-3*c*.

Further, as illustrated in FIG. 9 to FIG. 11, the third power source lines 461-3 of four systems are each connected to a conductive member 465 via the fourth connecting portions 461-3*c* by a bolt or the like. The conductive member 465 is a ring-shaped member having conductive property, such as copper. The conductive member 465 is connected to the pedestal 467 by a bolt or the like. According to the above-described structure, a voltage is applied from the power source 443 to the 12 pieces of contacts 469.

According to this embodiment, since the plurality of power source line members 461 are each connected to the contact member 468 passing through the support pillar 441 that supports the supporting mechanism 460, a voltage can be stably applied to the substrate Wf. That is, to feed power to the substrate Wf, it may also be considered to apply a voltage to the contacts 469 by passing a power source line from the power source 443 through the rotation shaft 448 and the back plate assembly 470, and connecting the power source line to the conductive member 465 or the pedestal 467. However, in this case, since the back plate assembly 470 moves up and down with respect to the supporting mechanism 460, a contact point where the back plate assembly 470 and the supporting mechanism 460 contact one another and become separated is generated between the back plate assembly 470 and the supporting mechanism 460, and as a result, a stability in the voltage application may possibly decrease by the contact point failure. In contrast to this, in this embodiment, since the power source line members 461 are routed so as to pass through the support pillars 441 instead of the back plate assembly 470, a contact point where contact and separation occur does not exist in the path between the power source 443 and the substrate Wf, and as a result, a voltage can be stably applied to the substrate Wf.

Figure 12A:
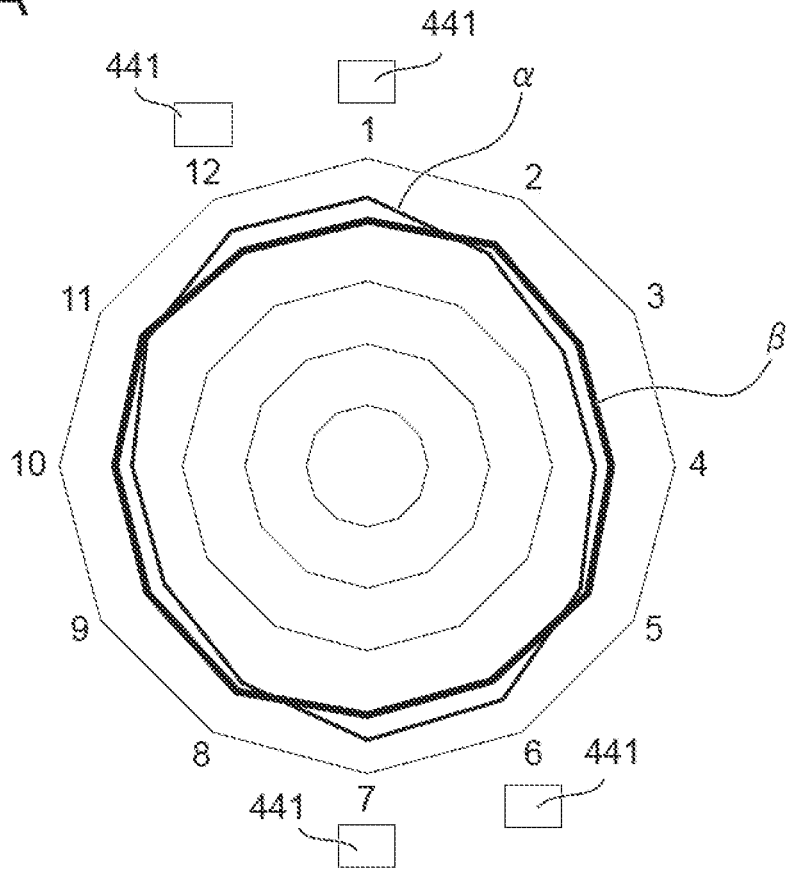
FIG. 12A is a drawing illustrating voltage distributions of 12 pieces of contacts of the substrate holder according to this embodiment and of a substrate holder according to a comparative example.
Figure 12B:
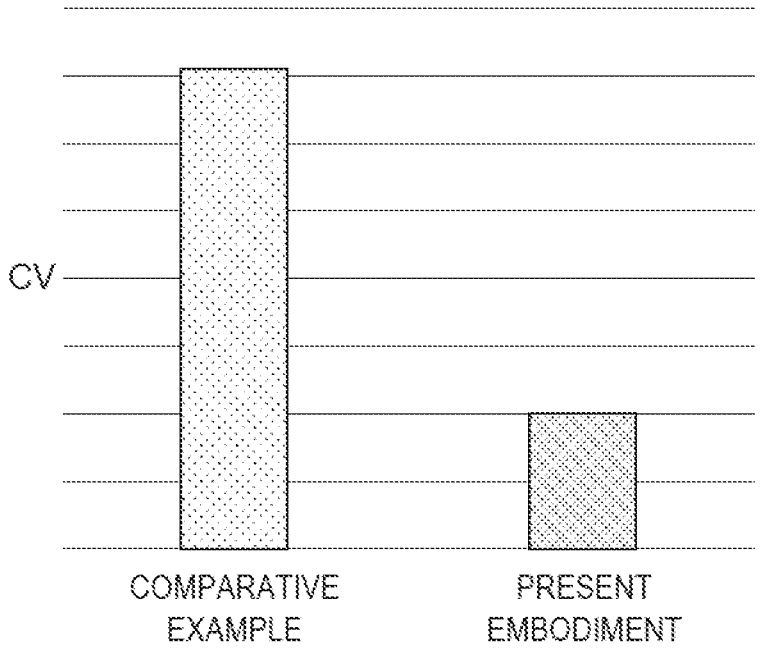
FIG. 12B is a graph indicating electric potential biases of the 12 pieces of contacts of the substrate holder according to this embodiment and of the substrate holder according to the comparative example.

Further, with this embodiment, an occurrence of varied power feeding to the contact member 468 can be suppressed. The following describes this point. FIG. 12A is a drawing illustrating voltage distributions of the 12 pieces of contacts of the substrate holder of this embodiment and a substrate holder of a comparative example. FIG. 12B is a graph indicating electric potential biases of the 12 pieces of contacts of the substrate holder of this embodiment and of the substrate holder of the comparative example. The vertical axis CV of the graph in FIG. 12B indicates a quotient in which a standard deviation (STD) of the electric potentials of the 12 pieces of contacts is divided by an average electric potential (AVE), and indicates a degree of the electric potential bias of the 12 pieces of contacts.

In the substrate holder of the comparative example, the support pillars 441 are disposed at positions similar to this embodiment, and power source lines routed passing through the support pillars 441 are directly connected to a ring-shaped conductive member and connected to the contact member (12 pieces of contacts) from the conductive member via a pedestal. As illustrated in the voltage distribution a of the substrate holder in the comparative example of FIG. 12A, voltages of the contacts arranged at positions close to the support pillars 441 become high, and voltages of the contacts arranged at positions far from the support pillars 441 become low. Further, as indicated in FIG. 12B, in the substrate holder of the comparative example, an electric potential bias of the 12 pieces of contacts has increased. This is considered to be caused by route lengths from the power source 443 to the 12 pieces of contacts being different. In contrast to this, in the substrate holder 440 of this embodiment, since the route lengths from the power source 443 to the contact member (12 pieces of contacts) are equal, as illustrated in the voltage distribution β in FIG. 12A, a voltage is equally applied to the 12 pieces of contacts. Further, as indicated in FIG. 12B, in the substrate holder 440 of this embodiment, the electric potential bias of the 12 pieces of contacts has decreased. Based on the above, with this embodiment, an occurrence of varied power feeding to the contact member 468 can be suppressed.

Figure 13:
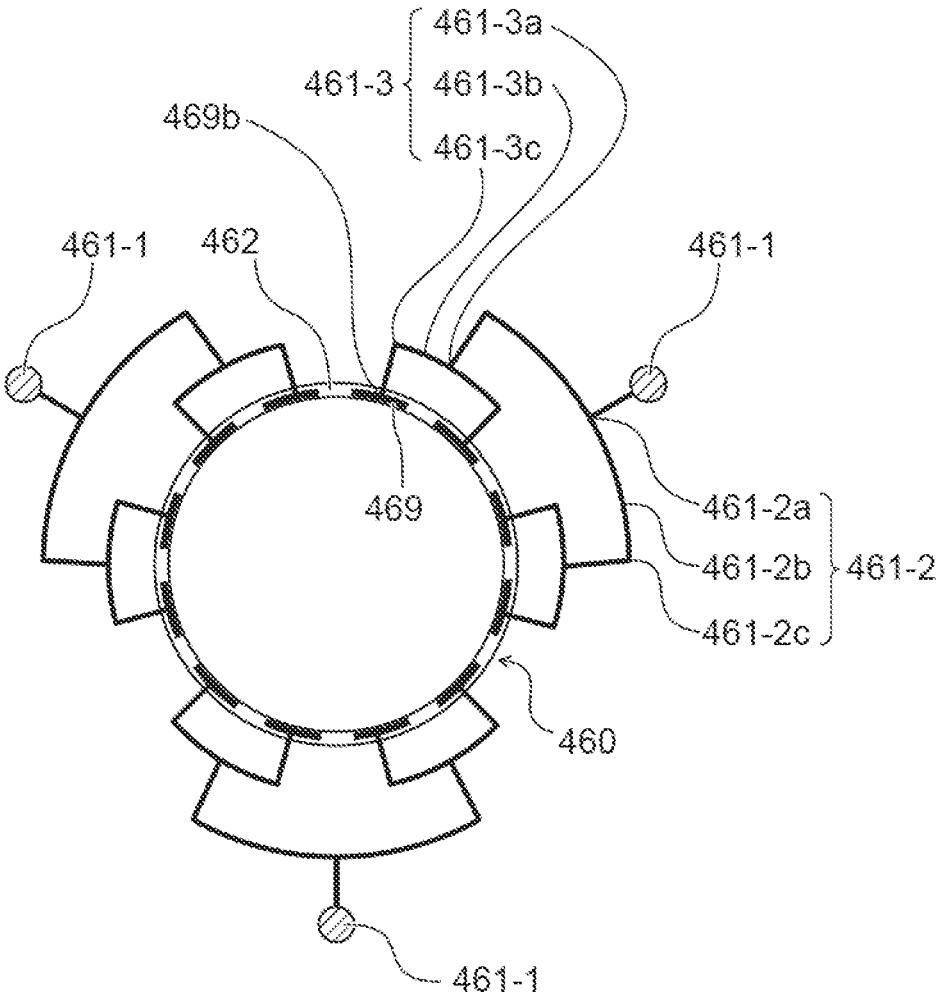
FIG. 13 is a drawing schematically illustrating a routing state of power source line members of a modification (of three systems).

While the above-described embodiment shows an example in which the power source line members 461 of four systems corresponding to the four support pillars 441 are disposed, the number of power source line members 461 are arbitrary. FIG. 13 is a drawing schematically illustrating a routing state of power source line members in a modification (of 3 systems). As illustrated in FIG. 13, in a case including three support pillars 441, the power source line members 461 of three systems are disposed. The power source line members 461 of three systems each include the first power source line 461-1, the second power source line 461-2, and the third power source line 461-3, which are similar to those in the above-described embodiment. According to this modification, similarly to the above-described embodiment, since the route lengths from the power source 443 to the contact member (12 pieces of contacts) are equal, an occurrence of varied power feeding to the contact member can be suppressed. In a hypothetical case where the positions of the three support pillars 441 are not at equal intervals along the circumferential direction of the supporting mechanism 460, similarly to the above-described embodiment, the coupling lines 461-5 can be disposed.

Figure 14:
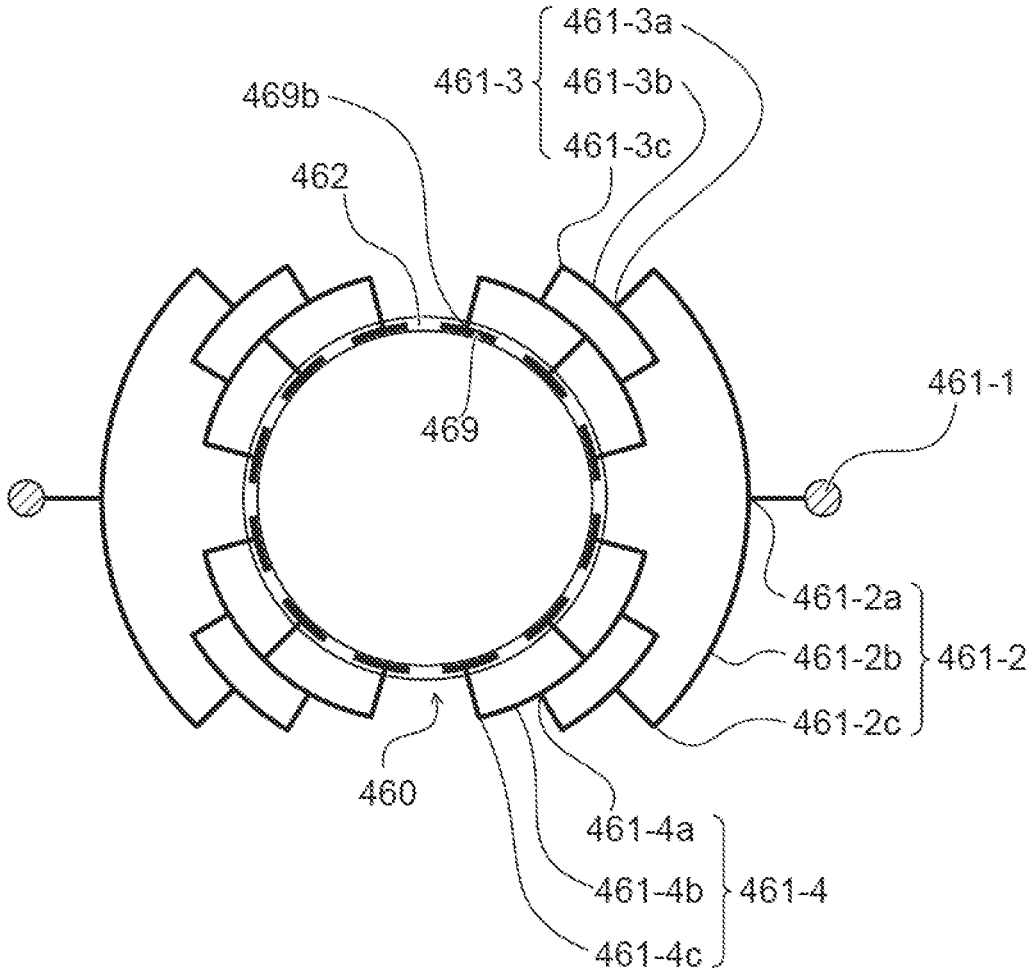
FIG. 14 is a drawing schematically illustrating a routing state of power source line members of a modification (of two systems).

FIG. 14 is a drawing schematically illustrating a routing state of power source line members of a modification (of 2 systems). As illustrated in FIG. 14, in a case including two support pillars 441, the power source line members 461 of two systems are disposed. The power source line members 461 of two systems each include the first power source line 461-1, the second power source line 461-2, and the third power source line 461-3, which are similar to those in the above-described embodiment. Further, the power source line members 461 of two systems each include a fourth power source line 461-4 connected to the third power source line 461-3. The fourth power source line 461-4 has a plurality of fifth connecting portions 461-4*a* connected to a plurality of the fourth connecting portions 461-3*c* of the third power source line 461-3, a third extending portion 461-4*b* extending from the fifth connecting portions 461-4*a* along the circumferential direction of the supporting mechanism 460, and a plurality of sixth connecting portions 461-4*c* disposed at positions equidistant from the fifth connecting portions 461-4*a* of the third extending portion 461-4*b*. The fourth power source line 461-4 is connected to a plurality of the power source connecting portions 469*b* via the plurality of sixth connecting portions 461-4*c*. According to this modification, similarly to the above-described embodiment, since the route lengths from the power source 443 to the contact member (12 pieces of contacts) are equal, an occurrence of varied power feeding to the contact member can be suppressed. In a hypothetical case where the positions of the two support pillars 441 are not at equal intervals along the circumferential direction of the supporting mechanism 460, similarly to the above-described embodiment, the coupling lines 461-5 can be disposed.

The embodiments of the present invention have been described above in order to facilitate understanding of the present invention without limiting the present invention. The present invention can be changed or improved without departing from the gist thereof, and of course, the equivalents of the present invention are included in the present invention. It is possible to arbitrarily combine or omit respective components according to claims and description in a range in which at least a part of the above-described problems can be solved, or a range in which at least a part of the effects can be exhibited.

This application, as one embodiment, discloses a plating apparatus including: a plating tank configured to house a plating solution; a substrate holder configured to hold a substrate with a surface to be plated facing downward; and an elevating mechanism configured to elevate the substrate holder. The substrate holder includes: a frame-shaped supporting mechanism configured to be suspended and held by a plurality of support pillars and to support an outer peripheral portion of the surface to be plated of the substrate; a back plate assembly configured to be arranged on a back surface side of the surface to be plated of the substrate and to sandwich the substrate with the supporting mechanism; a contact member arranged on the supporting mechanism, the contact member having a power feeding contact point in contact with the outer peripheral portion of the surface to be plated of the substrate and a plurality of power source connecting portions connected to a power source; and a plurality of power source line members connected from the power source to the plurality of power source connecting portions through the plurality of support pillars, the plurality of power source line members being routed such that distances from the power source to the plurality of power source connecting portions become equal.

This application, as one embodiment, further discloses a plating apparatus, in which the plurality of power source line members each include: a first power source line extending from the power source passing through the support pillar; and a second power source line having a first connecting portion connected to the first power source line, a first extending portion extending from the first connecting portion in both sides along a circumferential direction of the supporting mechanism, and a plurality of second connecting portions disposed at positions equidistant from the first connecting portion of the first extending portion. The second power source line is connected to the plurality of power source connecting portions via the plurality of second connecting portions.

This application, as one embodiment, further discloses a plating apparatus, in which the plurality of power source line members each further include a third power source line having a plurality of third connecting portions connected to the plurality of second connecting portions of the second power source line, a second extending portion extending from the third connecting portions along the circumferential direction of the supporting mechanism, and a plurality of fourth connecting portions disposed at positions equidistant from the third connecting portions of the second extending portion, the third power source line being connected to the plurality of power source connecting portions via the plurality of fourth connecting portions.

This application, as one embodiment, further discloses a plating apparatus, in which the plurality of power source line members each further include a coupling line extending from the first power source line along the circumferential direction of the supporting mechanism and is coupled to the first connecting portion such that the first connecting portions of the second power source lines are arranged at equal intervals along the circumferential direction of the supporting mechanism.

REFERENCE SIGNS LIST

400 . . . plating module
410 . . . plating tank
420 . . . membrane
430 . . . anode
440 . . . substrate holder
441 . . . support pillar
442 . . . elevating mechanism
443 . . . power source
446 . . . rotation mechanism
448 . . . rotation shaft
460 . . . supporting mechanism
461 . . . power source line member
461-1 . . . first power source line
461-2 . . . second power source line
461-2*a* . . . first connecting portion
461-2*b* . . . first extending portion
461-2*c* . . . second connecting portion
461-3 . . . third power source line
461-3*a* . . . third connecting portion
461-3*b* . . . second extending portion

461-3*c* . . . fourth connecting portion
461-5 . . . coupling line
462 . . . supporting member
465 . . . conductive member
467 . . . pedestal
468 . . . contact member
469 . . . contact
469*a* . . . power feeding contact point
469*b* . . . power source connecting portion
470 . . . back plate assembly
1000 . . . plating apparatus
Wf . . . substrate
Wf-a . . . surface to be plated

The invention claimed is:

1. A plating apparatus comprising:

a plating tank configured to house a plating solution;

a substrate holder configured to hold a substrate with a surface to be plated facing downward; and an elevating mechanism configured to elevate the substrate holder, wherein the substrate holder includes:

a frame-shaped supporting mechanism configured to be suspended and held by a plurality of support pillars and to support an outer peripheral portion of the surface to be plated of the substrate;

a back plate assembly configured to be arranged on a back surface side of the surface to be plated of the substrate and to sandwich the substrate with the supporting mechanism;

a contact member arranged on the supporting mechanism, the contact member having a power feeding contact point in contact with the outer peripheral portion of the surface to be plated of the substrate and a plurality of power source connecting portions connected to a power source; and a plurality of power source line members connected from the power source to the plurality of power source connecting portions through the plurality of support pillars, the plurality of power source line members being routed such that distances from the power source to the plurality of power source connecting portions become equal, wherein the plurality of power source line members each include:

a first power source line extending from the power source passing through the support pillar; and a second power source line having a first connecting portion connected to the first power source line, a first extending portion extending from the first connecting portion in both sides along a circumferential direction of the supporting mechanism, and a plurality of second connecting portions disposed at positions equidistant from the first connecting portion of the first extending portion, the second power source line being connected to the plurality of power source connecting portions via the plurality of second connecting portions.

2. The plating apparatus according to claim 1, wherein the plurality of power source line members each further include a third power source line having a plurality of third connecting portions connected to the plurality of second connecting portions of the second power source line, a second extending portion extending from the third connecting portions along the circumferential direction of the supporting mechanism, and a plurality of fourth connecting portions disposed at positions equidistant from the third connecting portions of the second extending portion, the third power source line being connected to the plurality of power source connecting portions via the plurality of fourth connecting portions.

3. The plating apparatus according to claim 1, wherein the plurality of power source line members each further include a coupling line extending from the first power source line along the circumferential direction of the supporting mechanism and is coupled to the first connecting portion such that the first connecting portions of the second power source lines are arranged at equal intervals along the circumferential direction of the supporting mechanism.

* * * * *